US005732767A

United States Patent [19]

Saperstein

[11] Patent Number: 5,732,767

[45] Date of Patent: Mar. 31, 1998

[54] CORROSION RESISTANT HEAT EXCHANGER AND METHOD OF MAKING THE SAME

[75] Inventor: Zalman Philip Saperstein, Lake Bluff, Ill.

[73] Assignee: Modine Manufacturing Co., Racine, Wis.

[21] Appl. No.: 590,092

[22] Filed: Jan. 24, 1996

[51] Int. Cl.[6] ..... F28F 19/06

[52] U.S. Cl. ..... 165/133; 165/134.1; 165/DIG. 513; 228/183; 420/540; 428/654

[58] Field of Search ..... 165/133, 134.1, 165/905, DIG. 513; 428/654; 420/540, 548; 228/183

[56] References Cited

U.S. PATENT DOCUMENTS

| | | | |
|---|---|---|---|
| 3,878,871 | 4/1975 | Anthony et al. | 165/134.1 |
| 4,410,036 | 10/1983 | Kanada et al. | 165/134.1 |
| 4,587,701 | 5/1986 | Koisuka et al. | 228/183 X |
| 4,732,311 | 3/1988 | Hasegawa et al. | 228/183 |
| 4,749,627 | 6/1988 | Ishikawa et al. | 428/654 |
| 4,781,888 | 11/1988 | Hagiwara et al. | 420/540 |
| 4,785,092 | 11/1988 | Nanba et al. | 420/540 |
| 4,892,141 | 1/1990 | Shiga et al. | 165/133 |
| 4,901,908 | 2/1990 | Negura et al. | 228/183 |
| 5,148,862 | 9/1992 | Hashiura et al. | 165/134.1 |
| 5,292,595 | 3/1994 | Yamauchi | 428/654 |
| 5,518,070 | 5/1996 | Kato | 165/134.1 X |

*Primary Examiner*—Leonard R. Leo

*Attorney, Agent, or Firm*—Wood, Phillips, VanSanten, Clark & Mortimer

[57] ABSTRACT

Inconsistent and costly corrosion protection with prior art heat exchangers are eliminated in a heat exchanger (10) formed of an aluminum fin (16) clad with an Al—Si—Zn braze clad compound (18), an aluminum tube (14) brazed to the fin (16), and bonded thereto by the braze clad compound (18) with zinc diffused into the tube, whereby the aluminum tube (14) is corrosion resistant by reason of the presence of sacrificial zinc therein.

3 Claims, 1 Drawing Sheet

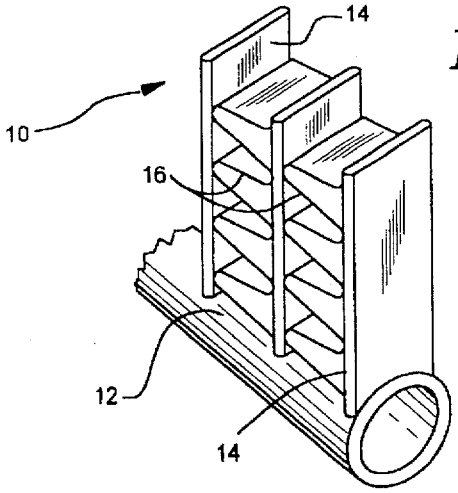
FIG. 1
FIG. 2
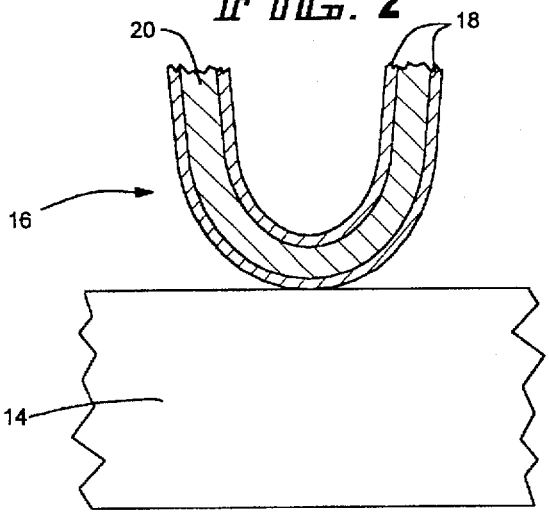
FIG. 3
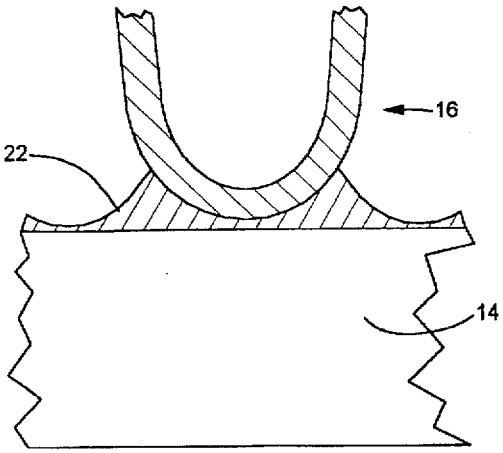
FIG. 4
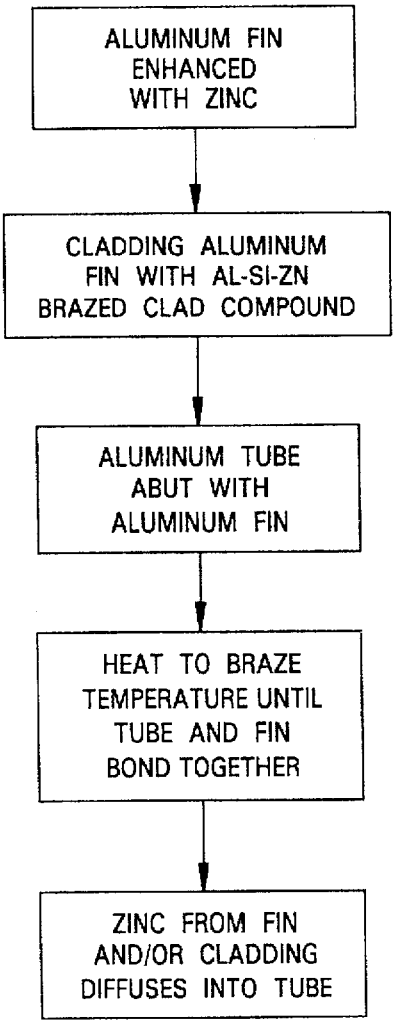

CORROSION RESISTANT HEAT EXCHANGER AND METHOD OF MAKING THE SAME

FIELD OF THE INVENTION

This invention relates to a heat exchanger, and more particularly, to a heat exchanger that is uniformly corrosion resistant, and easier and more economical to manufacture, and a method of producing the same.

BACKGROUND OF THE INVENTION

Due to its wide availability and excellent thermal conductivity properties many heat exchangers manufactured today are made of aluminum. Most desirably, extruded aluminum headers and/or tubes are used because of their low cost and ease of fabrication. Heat exchangers can be manufactured from several grades of aluminum, but commercially pure aluminum and extrudable aluminum alloys are most commonly used. Present within commercially pure aluminum are natural impurities such as iron, copper, and magnesium, etc., in extremely small concentrations.

Aluminum/aluminum alloy material used in constructing extruded tubes for use in heat exchangers is typically so called "commercially pure aluminum" (types 1100 and 1435, for example) or low alloy aluminum base (such as type 3003 or 3102). The aluminum materials frequently contain "tramp" elements such as iron, silicon, magnesium and the like as impurities introduced in the smelting process when scrap is used. Often, such tramp elements impair corrosion resistance of the base material.

Specifically, when exposed to a corrosive aqueous environment the aluminum is susceptible to pitting and general corrosion. Only ultra pure grade aluminum which has been stripped of "tramp" impurities and contains no added elements, is not susceptible to corrosion. However, its high cost makes it economically prohibitive to use in the manufacture of heat exchangers.

An aluminum heat exchanger, particularly one intended for vehicular use such as a radiator, oil cooler or condenser, is continually exposed to a moisture containing environment and is highly susceptible to corrosion. Corrosion of both the tubes and fins of an aluminum heat exchanger results in pitting on the surface. Eventually, as corrosion continues to eat away at the fins and tubes, holes will form in the tubes, allowing one of the heat exchanger fluids to leak, rendering the heat exchanger inoperative.

To combat these corrosion problems, it is known to link a sacrificial zinc containing material to the aluminum in order to reduce the corrosive attack on the tube of the heat exchanger. Specifically, it is known to include zinc in the core of the fins of an aluminum exchanger as is referred to in Japanese patent application no. 56-28899. The zinc in the core of the fins provides some limited corrosion resistance to the heat exchanger by creating sacrificial fins relative to the tubes. This configuration however, leaves the surface of the tubes basically exposed to the corrosive environment and does not substantially increase the life of the heat exchanger.

It is also known that when the aluminum tubes of the heat exchanger include a zinc component on their outer surface, the corrosive attack is made on the zinc component rather than on the aluminum base metal. Desirably, the zinc component is such that there is a gradient with a high concentration of zinc at the outer surface of the tube with a lesser concentration inwardly thereof. As a consequence, the corrosive attack on the tube occurs on the zinc component and spreads laterally along the tube surface where the zinc concentration is high, rather than through the tube wall, thereby reducing the formation of holes in the tube.

Applying this theory, attempts have been made to metallurgically modify the tube surfaces of extruded aluminum heat exchanger tubes by flame or plasma spraying zinc onto the surface of the extruded aluminum tubes. The process of zincating the tube surface through flame or plasma spraying creates a zinc diffusion gradient with a higher concentration of zinc on the outer surface of the tube. However, effective corrosion resistance is not achieved because of inconsistencies in the zinc concentrations along the tube surface.

Specifically, flame or plasma spraying of zinc cannot be precisely controlled and therefore significant variables in the zinc concentration on or near the tube surface exists. These variables may result in excessive concentrations of zinc on the tube-to-header joints, with corrosion rapidly degrading these joints, and at the same time, inadequate zinc concentrations along other portions of the tube resulting in spots more susceptible to hole formation.

Additionally, flame and plasma spraying, though the most economical zincating processes, increases the cost and complexity of manufacturing aluminum heat exchangers. This zincating process adds a time consuming and somewhat complicated additional manufacturing step to the manufacturing process, and still results in only inconsistent variable corrosion resistance of the heat exchanger.

Heat exchangers employing so-called "fabricated tubes" on the other hand, have offered good corrosion resistance. Fabricated tubes are disclosed in U.S. Pat. No. 4,688,311 issued Aug. 25, 1987 to Saperstein, et al. As noted therein, flattened tubes are formed by welding using a stock which is clad with a braze alloy on the outside, or, in some cases, braze clad both inside and out.

Typically, the braze alloy with which the tube is clad will contain a low percentage of zinc which then acts as a sacrificial element in preventing pitting corrosion.

Fabricated tubes, however, require the additional fabrication of a wavy insert and the insertion of the wavy insert into each flattened tube where it is ultimately brazed into place. As a consequence, while fabricated tubes provide superior corrosion resistance to state of the art extruded tubes, they are more expensive because of the additional fabrication costs involved.

Thus, there is a real need for a heat exchanger tube that may be formed with the economy associated with extruded tubes and yet possess the corrosion resistance of fabricated tubes.

SUMMARY OF THE INVENTION

It is the principal object of the invention to provide a new and improved heat exchanger that is consistently resistant to corrosion. It is also a principal object of the invention to provide a method of producing a heat exchanger with increased protection from corrosion, at a reduced cost, and by a simplified method of manufacturing.

It is also an object of the invention to provide a method of producing a heat exchanger with consistent protection from corrosion along the tube of the heat exchanger.

It is also an object of the invention to provide a method of producing a heat exchanger with increased protection from corrosion, which precisely controls the zinc enhancement of the heat exchanger.

According to one aspect of the invention, the above objects are realized in a heat exchanger including an aluminum fin with an exterior cladding of aluminum braze alloy containing a small percentage of zinc. The fin is brazed to an extruded aluminum heat exchanger tube and bonded thereto by the braze alloy. Zinc from the braze alloy is at least partially diffused into the surface of the tube. As a consequence of this construction, the aluminum tube is corrosion resistant by reason of the presence of sacrificial zinc therein.

Because the heat exchanger tube is an extruded aluminum heat exchanger tube, it will generally be of a commercially pure grade of aluminum or an extrudable aluminum alloy, and thus essentially zinc free.

In a preferred embodiment, the exterior cladding of the aluminum fin on each side is of a thickness ranging from about 5–15% of the overall fin thickness.

In a preferred embodiment, the zinc in the exterior cladding is at least about 2% by weight.

In a preferred embodiment, zinc from the aluminum braze alloy diffuses into said tube and creates a diffusion gradient in the tube wall with the highest concentration of zinc at an outer surface of the tube.

In a preferred embodiment of the invention, the diffusion gradient within the tube is at least 0.8% zinc by weight at the outer surface of the tube, decreasing to at least 0.2% zinc by weight at a distance in the range of about 80–100 microns from the outer surface.

In one embodiment of the invention, according to another facet thereof, an aluminum fin having a zinc containing aluminum core and an exterior Al—Si—Zn braze cladding containing at least about 1.5% zinc by weight is brazed to an extruded, commercially pure aluminum tube and bonded thereto by the Al—Si—Zn braze cladding. A fillet of Al—Si—Zn braze cladding is formed at the tube/fin interface, and because the tube is formed of commercially pure aluminum and is essentially zinc free, zinc from the fillet is diffused into the tube to provide a gap free diffusion zone about the entirety of the extruded tube, at a diffusion gradient having the highest concentration of zinc at an outer surface of the tube, whereby the aluminum tube is corrosion resistant by reason of the presence of sacrificial zinc thereon.

To enhance the diffusion, a highly preferred embodiment of the invention contemplates that the core of the fin includes zinc to the same or greater concentration as the braze cladding or alloy to thereby promote diffusion of the zinc into the tubes, rather than into the fins.

According to still another facet of the invention, the above objects are realized in a method of producing a heat exchanger with increased protection from corrosion, comprising the following steps: a) providing an aluminum fin coated with an Al—Si—Zn braze alloy; b) providing a predominantly aluminum extruded tube which is essentially free of zinc abutted to the fin; and c) subjecting the fin and tube to a brazing temperature for a time sufficient to cause the fin and tube to braze together and cause zinc from the braze alloy to rapidly diffuse into the tube. As a consequence, the tube is corrosion resistant by reason of the presence of sacrificial zinc therein.

In a preferred method, the Al—Si—Zn braze alloy on the fin has a thickness in the range of about 5–15% of the overall fin thickness on each side and includes at least 1.5% zinc by weight.

In a preferred method, the step of brazing the fin and tube includes the step of forming a fillet of Al—Si—Zn braze alloy on the tube immediately adjacent the fin, and further including the step of forming a liquid molten fillet for approximately 30 seconds or less, wherein zinc from the molten fillet rapidly diffuses multidirectionally into the tube creating a diffusion gradient in the tube having the highest concentration of zinc at an outer surface of the tube.

In a preferred method, the diffusion gradient within the tube results in at least 0.8% zinc by weight at the outer surface of the tube decreasing to at least 0.2% zinc by weight at a distance of about 80–100 microns from the outer surface.

In one method of producing a compact thin walled heat exchanger with increased protection from pitting, an aluminum fin having a thickness of about 0.006 inches and a zinc containing aluminum core, is clad with a layer of Al—Si—Zn braze alloy comprising at least 2% zinc by weight. An extruded aluminum tube of commercially pure aluminum, having a wall thickness of about 0.02 inches or less is abutted the fin and subjected to a brazing temperature of at least 1100° F. for approximately two minutes or less thereby causing a fillet of braze alloy to form on the tube adjacent the fin, said fillet remaining in a liquid molten state for approximately 30 seconds or less, causing the fin and tube to braze together with zinc from the liquid molten braze alloy diffusing into the tube along its entire surface.

Other aspects and advantages will become apparent from the following specification taken in connection with the accompanying drawings.

DESCRIPTION OF THE DRAWINGS

FIG. 1 is a fragmentary perspective view of a heat exchanger made according to the invention with parts shown in section;

FIG. 2 is a somewhat schematic view of a potential joint between a fin and a tube prior to brazing;

FIG. 3 is a view similar to FIG. 2 but illustrating a fillet of aluminum braze alloy bonding the fin to the tube after brazing;

FIG. 4 is a block diagram of the steps in a method of producing a heat exchanger with increased protection from corrosion.

DESCRIPTION OF THE PREFERRED EMBODIMENT

In the illustrative embodiment as disclosed in FIG. 1, a heat exchanger, generally designated 10, made according to the invention, is seen to include a pair of elongated, generally cylindrical headers 12 (only one of which is shown). Typically, but not always, the headers 12 will be formed of tubing made by extrusion or welding and of commercially pure aluminum or an aluminum alloy.

Extending between the headers 12 and in fluid communication with the interior thereof are a plurality of tubes 14. The tubes are typically flattened extrudable tubes made of commercially pure aluminum or an extruded aluminum alloy (a low alloy which is essentially zinc free) and received in slots (not shown) in the headers 12. The tubes 14 are brazed to the headers 12 as will be seen. The tubes 14 conventionally have a wall thickness of about 0.020 inches or less.

In the illustrated embodiment as seen in FIG. 1, a series of fins 16 are located between and brazed to the tubes 14. As is well known, most usually serpentine fins 16 are disposed between adjacent flattened tubes 14, and again, the fins 16 are typically made of commercially pure aluminum. In one embodiment, the core 20 of each fin 16 is enhanced with zinc (not shown).

As illustrated in FIG. 2, an exterior cladding of aluminum braze alloy 18 containing a small percentage of zinc, (not shown) coats the fins 16 on each side. Prior to brazing, as depicted in FIG. 2, the exterior cladding 18 on each side of each aluminum fin 16 has a thickness ranging from 5–15% of the overall fin thickness, which typically will be about 0.006 inches or less. In one embodiment of the invention, the exterior cladding 18 of each aluminum fin 16 includes at least about 1.5% zinc by weight, and preferably, the exterior cladding includes at least 2% zinc by weight. In either case, the core 20 of the fin 16 preferably includes a zinc concentration approximately equal to or greater than the amount of zinc that is in the exterior cladding 18.

As illustrated in FIG. 3, the fin 16 is brazed to an unclad aluminum tube 14, and bonded thereto by the braze alloy 18, with zinc from the braze alloy 18 being at least partially diffused (not shown) into the tube 14.

More specifically, as shown in FIG. 3, during the brazing process, a fillet 22 of Al—Si—Zn braze alloy 18 forms on the tube 14 adjacent the fin 16 and causes the fin 16 and tube 14 to braze together. The braze alloy wets the entire exterior of the tubes 14. The fin 16 and the tube 14 are brazed at a temperature of at least 1100° F. and bonded thereto by the Al—Si—Zn braze alloy 18. Zinc from the alloy 18 is diffused into the tube 14 to provide a gap free diffusion zone about the entirety of the tube, at a diffusion gradient having the highest concentration of zinc at an outer surface of the tube 14. The diffusion zone is "gap free" in the sense that it is not interrupted by areas of no zinc or areas with very little zinc as occurs with metallurgically modified surfaces produced by flame or plasma spraying methods. The aluminum tubes 14 are now corrosion resistant. By reason of the presence of sacrificial zinc at a diffusion gradient (not shown) within the tube 14 of at least 0.8% zinc by weight at the outer surface of said tube 14 decreasing to at least 0.2% zinc by weight at a distance in a range of about 80–100 microns from the outer surface, any corrosion attack will spread laterally along the surfaces of the tubes 14 rather than penetrate the walls of the tubes 14.

The manner in which a heat exchanger with increased protection from corrosion is produced is diagrammatically shown in FIG. 4. An aluminum fin 16 is clad with an Al—Si—Zn braze alloy 18 containing at least 1.5% zinc by weight.

An extruded aluminum tube 14 initially essentially zinc free is abutted with the fin 16 and subjected to a brazing temperature of at least 1100° F. for a time sufficient to cause the fin and tube to braze together, and cause zinc from the fin 16 to diffuse into the tube 14. Typically, the heat exchanger will be in the brazing zone of a conventional brazing furnace employing the Nocolok® brazing process for two minutes or less at a brazing temperature in the range of 1100°–1120° F. This provides adequate time for liquation of the braze alloy (about 30 seconds or less) while assuring that the braze alloy will not dissolve the base metal of the components to the point where erosion completely through the components occurs.

Preferably, the braze alloy forming the cladding 18 on the fin 16 contains at least 2% zinc by weight. This concentration is adequate for typical fin densities and Nocolok® brazing. However, as fin density decreases or if a vacuum brazing process is used, it may be necessary to increase the zinc concentration in the braze alloy on the fins in order to assure the presence of an adequate amount of zinc for diffusion into the surfaces of the tubes 14 to produce the desired diffusion gradient therein.

The step of brazing the fin 16 the tube 14 includes the step of forming a fillet 22 of Al—Si—Zn braze alloy on the tube 14 immediately adjacent the fin. Zinc from the fillet 22 rapidly diffuses multidirectionally into the tube along its entire surface and creates a diffusion gradient in the tube having the highest concentration of zinc at an outer surface of the tube. The diffusion gradient within the tube is at least 0.8% zinc by weight at the outer surface of the tube decreasing to at least 0.2% zinc by weight at a distance of about 80–100 microns from said outer surface.

The foregoing method provides a simple and efficient process for precisely controlling the zinc enhancement of the heat exchanger using extruded components, thereby providing protection from pitting along the tubes of the heat exchanger.

As noted previously, it is preferred that the core of the fins 16 include zinc at the same concentration or greater than the zinc in the braze alloy with which the fins are clad. At the same time, the tubes 14, formed of a commercially pure grade of aluminum, or an extrudable aluminum alloy will be essentially zinc free. In one embodiment, the extruded tube 14 has a base metal which is essentially zinc free.

As is well known, diffusion will occur at a rate proportional to the difference in concentration. As a consequence, since the core of the fin 16 has an equal or greater concentration of zinc than the braze alloy, while the tubes 14 have a lesser effectively zero concentration, diffusion of the zinc is directed away from the core of the fins and specifically toward the tubes to provide the aforementioned diffusion gradient.

The result is a compact thin walled heat exchanger that may be made of extruded components, including extruded tubes, wherein the tubes have a greater concentration of sacrificial zinc on their outer surface than inwardly thereof. As a consequence of this, when a corrosion attack occurs, the corrosion of the sacrificial zinc occurs along the surface of the tube, spreading laterally, rather than penetrating the tube wall to the point of rendering the heat exchanger inoperative.

Thus, the method of the present invention provides a means whereby tubes such as extruded tubes are ultimately provided with sacrificial zinc at a relatively high concentration along their surface and at a lesser concentration inwardly thereof. Because the tube surfaces are wetted with the braze alloy containing the zinc during the brazing process, distribution of the zinc along the surfaces is much more uniform than can be achieved by flame or plasma spraying, and excellent corrosion resistance results. In addition, we believe that the method of the present invention can be used with the flame or plasma spraying processes to even out the zinc diffusion gradient along the tubes of the heat exchanger.

The presence of zinc in the core of the fins 16 also causes the fins to become sacrificial components relative to the tubes of the heat exchanger.

Copper Accelerated Acetic Acid-Salt Spray (CASS) testing performed on a heat exchanger made according to this invention demonstrates the consistent corrosion resistance achieved through the enhancement of the braze clad material with zinc. CASS tests run according to the procedures set forth by The American Society for Testing Materials, have shown that a zinc enhanced heat exchanger made according to the invention and including 2% zinc by weight in the core of the fins and 2% zinc by weight in the exterior cladding of the fins has a CASS life of over 2000 hours. In comparison, a heat exchanger with only 1% zinc by weight in the core and cladding of the fins only had a CASS life of 200–500 hours, and a heat exchanger without any zinc in either the core or the exterior cladding of the fins resulted in a CASS life of only 50–200 hours.

From the foregoing, it will be readily appreciated that a heat exchanger made according to this invention is highly advantageous in that it has increased protection from corrosion with a significantly increased useful life, is relatively simple to manufacture, and is less costly to produce.

I claim:

1. A corrosion resistant aluminum heat exchanger, comprising:

an aluminum fin containing a zinc enhanced core, having an exterior cladding of aluminum braze alloy containing at least about 1.5% zinc by weight, the percentage of zinc in the alloy about equal to or less than the concentration of zinc in the core of the fin; and an extruded tube of commercially pure or low alloy aluminum brazed to said fin and bonded thereto by said braze alloy;

zinc from said braze alloy being at least partially diffused into said tube along its surface;

whereby the aluminum tube is corrosion resistant by reason of the presence of sacrificial zinc therein.

2. The heat exchanger of claim 1, wherein the zinc in the braze alloy of the aluminum fin is at least about 2% zinc by weight.

3. In a corrosion resistant aluminum heat exchanger having an aluminum fin with a zinc enhanced core and an exterior aluminum braze cladding enhanced with zinc, and an extruded tube free of zinc brazed to said fin and bonded thereto by said braze cladding, the improvement wherein:

the zinc concentration in the braze cladding is at least about 2% zinc by weight and is about equal to or less than the zinc concentration in the core of the fin; and the zinc from said braze cladding is at least partially diffused into the extruded tube along a diffusion zone about the entirety of the extruded tube;

whereby the extruded tube is uniformly corrosion resistant by reason of the presence of the sacrificial zinc thereon.

* * * * *